US007084365B2

(12) United States Patent
Whitnable

(10) Patent No.: US 7,084,365 B2
(45) Date of Patent: Aug. 1, 2006

(54) METHODS AND APPARATUS FOR A NON-DISCRETE SORTATION PROCESS

(75) Inventor: B. Daniel Whitnable, Madison, WI (US)

(73) Assignee: Lands' End Direct Merchants, Inc., Minneapolis, MN (US)

( * ) Notice: Subject to any disclaimer, the term of this patent is extended or adjusted under 35 U.S.C. 154(b) by 42 days.

(21) Appl. No.: 10/223,185

(22) Filed: Aug. 19, 2002

(65) Prior Publication Data

US 2004/0031732 A1 Feb. 19, 2004

(51) Int. Cl.
*B07C 5/00* (2006.01)

(52) U.S. Cl. ..... 209/584; 209/900

(58) Field of Classification Search ..... 209/584, 209/900, 44.1, 592, 586, 645, 659; 414/270, 414/271, 272

See application file for complete search history.

(56) References Cited

U.S. PATENT DOCUMENTS 4,171,744 A * 10/1979 Hubbard ..... 209/586
5,009,321 A * 4/1991 Keough ..... 209/3.1
5,893,464 A * 4/1999 Kiani et al. ..... 209/584
5,901,855 A * 5/1999 Uno et al. ..... 209/584
5,994,657 A * 11/1999 Maier et al. ..... 209/584
6,107,588 A * 8/2000 De Leo et al. ..... 209/584
6,274,836 B1 * 8/2001 Walach ..... 209/584
6,291,785 B1 * 9/2001 Koga et al. ..... 209/584
6,323,452 B1 * 11/2001 Bonnet ..... 209/583
6,501,041 B1 * 12/2002 Burns et al. ..... 209/584
6,515,246 B1 * 2/2003 Brandsaeter ..... 209/583
6,566,620 B1 * 5/2003 Lohmann ..... 209/584
6,576,857 B1 * 6/2003 De Leo et al. ..... 209/584
6,677,548 B1 * 1/2004 Robu et al. ..... 209/583
2002/0179502 A1 * 12/2002 Cerutti et al. ..... 209/583
2003/0066736 A1 * 4/2003 Edwards et al. ..... 198/370.06
2005/0080520 A1 * 4/2005 Kline et al. ..... 701/1
2005/0189271 A1 * 9/2005 Cerutti et al. ..... 209/583

FOREIGN PATENT DOCUMENTS

EP 0 718 049 A2 6/1996

* cited by examiner

*Primary Examiner*—Eileen D. Lillis
*Assistant Examiner*—Matthew J. Kohner
(74) *Attorney, Agent, or Firm*—Snell & Wilmer L.L.P.

(57) ABSTRACT

A system and method for distributing and sorting discrete items into a large quantity of discrete groups is provided. The system includes multiple sorting steps including an upstream sorting step that sorts items into both discrete and non-discrete groups and a downstream sorting step that sorts the non-discrete groups into discrete groups for further processing.

34 Claims, 8 Drawing Sheets

METHODS AND APPARATUS FOR A NON-DISCRETE SORTATION PROCESS

FIELD OF INVENTION

The present invention generally relates to systems for sorting individual items into groups of items. More particularly, the invention relates to systems and methods having at least two sorting steps including at least one intermediate step that sorts items into non-discrete groups.

BACKGROUND OF THE INVENTION

Distribution centers experience increased demands as the number of goods shipped per unit of time increases. Typically, the infrastructure of distribution centers is relatively fixed, allowing for only marginal increases in throughput capacity without substantial investment in capital improvements.

For example, a distribution center may enhance throughput of existing systems by increasing the speed of conveyors and sorters, but only to a limited extent due to constraints such as conveyor belt size and strength, the momentum of moving items, and the configuration and location of sorting binds. Likewise, a distribution center may extend its operation but at substantial increase in operating costs including hours of labor and energy costs. Faced with these choices, distributors often build larger facilities to handle these increased demands. In addition to the obvious transactional costs associated therewith, including real estate acquisition and construction expenses, these bigger facilities impose larger fixed overhead costs that reduce profits, especially in times of decreased demand or fluctuations in supply.

Common sorting methods include bringing disparate items to a common location where sorting functions are carried out in a series of steps. Though the precise nature of existing sorting systems may be highly individualized, they generally require a discrete destination for each group or compound group of items. These discrete destinations usually involve a chute or a bin, among others. For example, if a distribution center needs to sort items into one thousand separate "groupings" of items (also referred to as "orders"), the system may include one thousand different discrete sorting destinations.

As shipping demands increase, the need for distribution centers with even greater capacity increases accordingly. The physical size of such buildings is substantial, challenging the capital resources of even the largest distributors. Such demands test the limits of complexity and logistical capacities of existing sorting technologies as well. Equipment needed to transport final groupings to downstream processes further increase as the quantity of sorting destinations increase. Transporting groupings from upstream to downstream locations in a continuous, sequential manner is not always possible, especially in larger systems. Moreover, the rates and timing of upstream processing are often poorly synchronized with downstream processes, necessitating buffer stations at various accumulation points throughout the distribution center.

Accordingly, it is desirable to reduce the number of sorting destinations while maintaining high throughput. One method of reducing the number of sorting destinations is to introduce an intermediate or secondary sorting step. In conventional systems employing such methods, an intermediate sorting stage tends to decrease the number of sorting destinations in of the system. As an example, consider a distribution center for sorting various items into one thousand predetermined groups of items ("orders"). An intermediate sort could be implemented at a first sorting station to sort the items into 20 compound groups at 20 sorting destinations, with each compound group containing 50 orders. Each of the 20 compound groups could thereafter undergo an additional sorting step in which the compound groups are sorted into 50 order groups at 50 sorting destinations. This exemplary system could accomplish a thousand group sort with only 70 total sorting destinations (20+50=70).

Prior attempts to introduce multiple sorting steps have revealed several drawbacks, especially if it is presumed that entropy must be reduced to the fullest practical extent at each shorting step. Consequently, these systems typically strive to maintain absolute discretion between the sorted groups or subgroups. That is, conventional systems do not allow intermixing between sorted groups. This requirement for absolute discretion places many restraints upon system configuration and flexibility, thereby decreasing system efficiencies.

Further system limitations also tend to minimize the attractiveness of intermediate sort processing. Reductions in capital equipment realized from intermediate sorting tends to be at least partially offset by an increase in the hardware required to transport the goods between the sorting stations. Additionally, bottlenecking tends to occur at downstream sorting destinations when previously sorted groups are not transported away as fast as upstream processes are able to replenish their supply. In this regard, such systems tend to require added sorting destinations or large amounts of buffering or accumulation equipment to compensate for these timing problems.

Accordingly, an improved system for sorting and distributing discrete items into large quantities of unique groups is desired.

SUMMARY OF THE INVENTION

The present invention addresses the shortcomings of the prior art by providing a convenient and cost-effective system and method for sorting large quantities of discrete items into a large number of groups for further routing and distribution. While the way in which the present invention provides these advantages will be described in greater detail below, in general, the present invention provides a system for efficiently sorting various items received from an upstream input source into various order groups for further downstream processing. The system may include intermediate sorting steps. Such intermediate sorting steps may be useful in reducing the overall number of sorting destinations required for the distribution system. The system may also include a non-discrete intermediate sorting step. In accordance with various embodiments of the present invention, such a non-discrete sorting step can increase the efficiency and reduce the overall size and complexity of distribution systems.

In accordance with a further aspect of the present invention, a non-discrete sorting step is provided which sorts items into discrete groups, but which may also include regions of non-discrete items interposed between discrete groups.

In accordance with a further aspect of the present invention, during the final sorting step, the discrete groups of items previously sorted in the intermediate sorting step may undergo a conventional final sort, whereupon the non-discrete items between the groups of discrete items may also undergo a final sort using additional final sort designations.

BRIEF DESCRIPTION OF THE DRAWINGS

A more complete understanding of the present invention may be derived by referring to the detailed description and claims, considered in connection with the figures, wherein like reference numbers refer to similar elements throughout the figures, and:

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

The present invention is described herein in terms of various functional components and processing steps. It should be appreciated that such functional components may be realized by any number of hardware or structural components configured to perform the specified functions.

Figure 1:
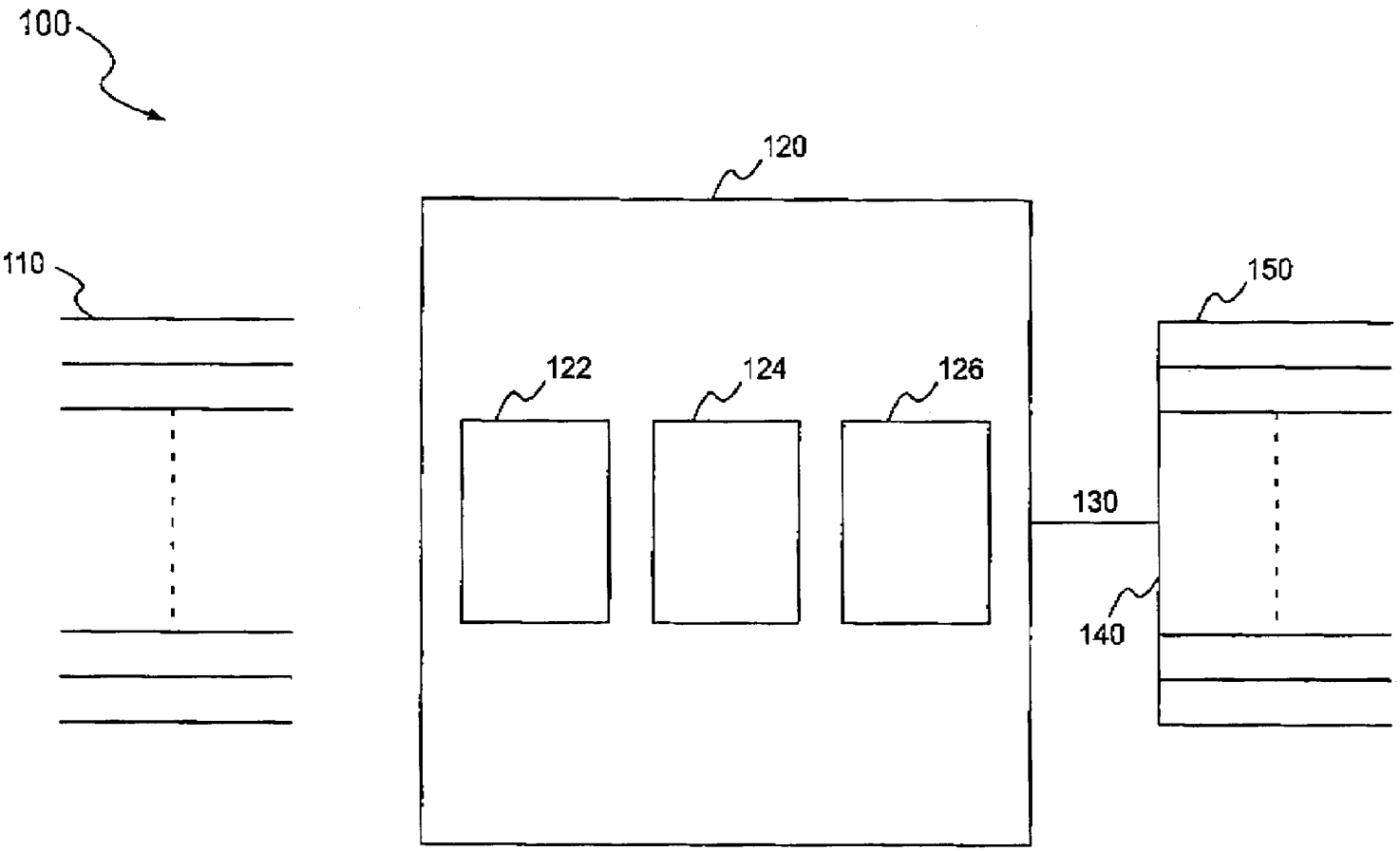
FIG. 1 (PRIOR ART)
FIG. 1 is a schematic block diagram of a conventional sorting/distribution system.

Conventional distribution systems typically require the sorting of thousands of items for ultimate packaging and shipping to various downstream customers and other recipients. Such distribution systems typically interact with a variety of input and output sources. FIG. 1 illustrates the process architecture typically found in common distribution systems 100. Items are received by the distribution center through a variety of input sources 110, such as shipping yards, delivery docks, mailrooms, and the like. The received items are processed in a distribution center 120, typically in an intake processing location 122.

The processed items are then transported to a sorting station 124. In its most basic sense, such sorting may involve individually selecting items from a large group of items to fulfill an individual order. For example, in the apparel industry, received items may be dumped in a central location, such as sorting tables. Employees then sort through the random piles of garments, for example men's and ladies' clothing, to select individual garments to fulfill a particular order. The selected items are then placed into individual bins to await further processing.

After at least some of the items have been sorted into groups, the groups are typically transported to a shipping location 126. Shipping locations typically process grouped items for shipment. Such processes include packaging the groups and placing the groups in appropriate containers for shipping, such as envelopes, bags, boxes, drums, containers, and the like. The processed groups are then transported 130 to a distribution center 140 for further sorting. The distribution center 140 typically sorts the groups according to shipper designation. For example, the sorted groups may be placed onto loading docks 150 for pick-up by U.S. mail, United Parcel Service, Federal Express, various trucking companies, and the like.

As used herein, "group," and various permutations thereof, typically relates to a plurality of items (or even constituting a logical group of items), such as an order for several items placed by a consumer from a catalog. "Sorting," and various permutations thereof, means any activity in which an item is distinguished or selected from a non-homogeneous assemblage of items based on a given metric or characteristic, such as size, weight, color, geographic origin, hazardous/non-hazardous, perishable/non-perishable, and the like.

As discussed above, conventional single stage sorting systems generally designate a single sorting destination for each group. In the example above, one hundred individual destination bins may be designated for one hundred different discrete order groups. However, as the number of required groups increases, the number of sorting destinations can quickly multiply to an unmanageable number. Prior attempts have been made to reduce the number of sorting destinations by introducing intermediate sorting steps, as discussed above.

Figure 2:
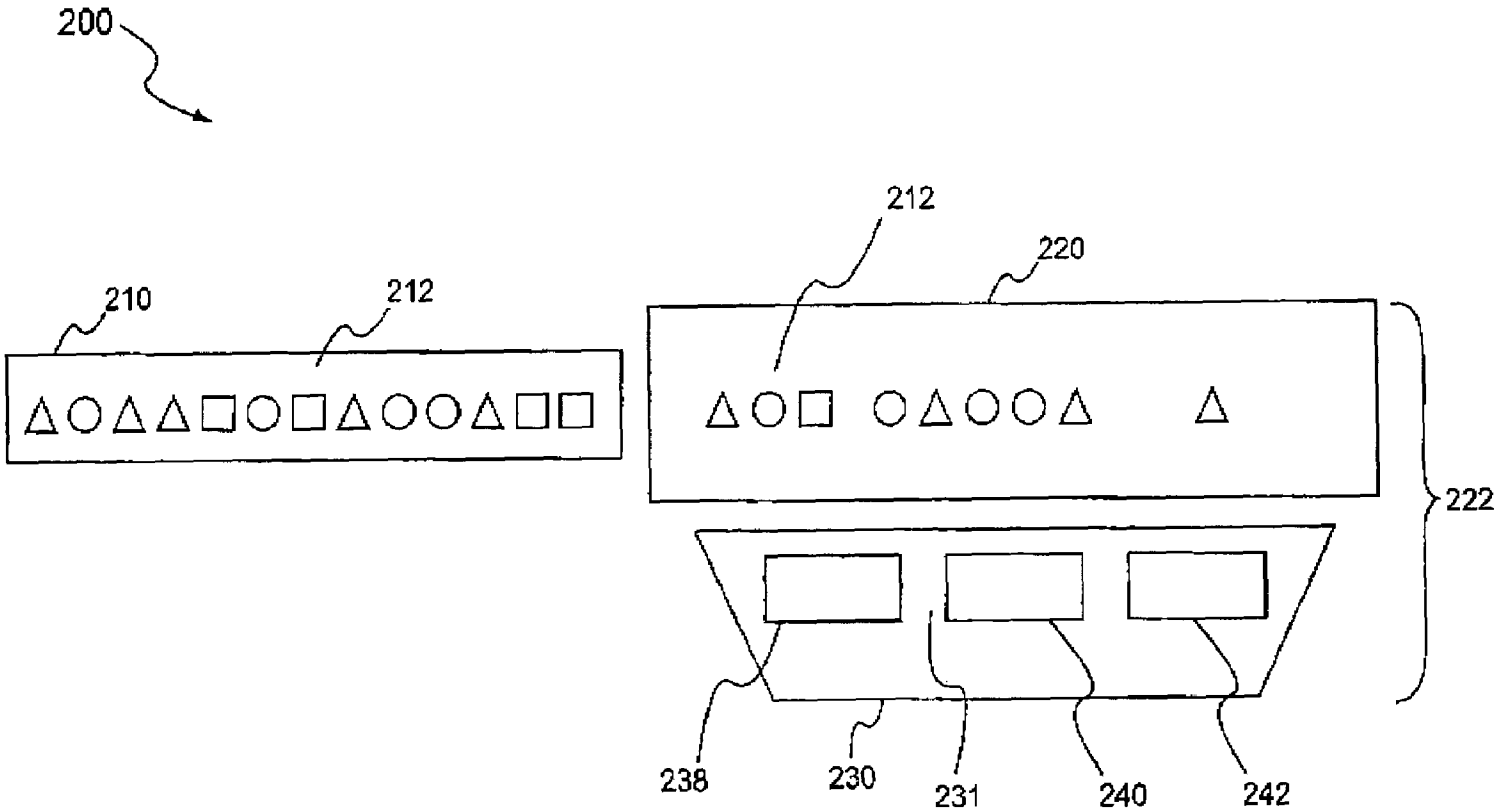
FIG. 2 (PRIOR ART)
FIG. 2 is a schematic block diagram of a discrete sorting stage.

Referring now to FIG. 2, a schematic illustration of an intermediate sorting step used in a conventional sorting system 200 is shown. A primary induct 210 (e.g., a conveyer) is linked to a sorting station 222. In the illustrated embodiment, sorting station 222 comprises a sorting conveyor 220 and an accumulator 230, wherein accumulator 230 may include one or more sorting destinations 238, 240, and 242. In the illustrated embodiment, the various sorting destinations may comprise structural bins, shutes, or partitioned regions; alternatively, the sorting destinations may simply comprise predetermined areas or regions on the surface of or otherwise within accumulator 230. In this regard, it is not uncommon for such systems to comprise many sorting destinations, for example one hundred or more.

Unsorted incoming items 212 are introduced into the sorting system 200 through primary induct 210. The random items 212 may comprise virtually any number and configuration of items to be sorted, using virtually any sorting criteria. Moreover, the incoming items may be random, pseudo-random, unsorted, partially sorted, recycled items, or a mixture of recycled and newly introduced items. The incoming items may comprise any number of distinct items to be sorted into virtually any number of groups or compound groups. In the embodiment shown in FIG. 2, incoming items 212 are represented as three different classes of items (circles, triangles, and squares), such that the squares are assembled into destination 238, the circles are assembled into destination 240, and the triangles are assembled into destination 242 as conveyor 220 carries the items past the sorting destinations.

As briefly mentioned above, each of the "classes" of items, for example, items represented as triangles, may constitute a compound group containing a number of subgroups to be sorted in a subsequent sorting operation. For example, as explained above, a first sorting station could sort the incoming items into 20 compound groups each containing 50 order groups. Each of the compound groups could then be subject to a secondary sort step where each of the 20 compound groups would be sorted into 50 individual order groups (not shown). This may be facilitated, for example, by manually or otherwise moving each of the sorting destinations (or sorting bins), or even accumulator 230, to a downstream location for further sorting, such as another sorting station.

Any suitable metric or set of metrics may be used to separate or group items in an intermediate sort. For example, items may be identified as having one or more characteristics, and thus be placed in a particular class corresponding to that characteristic or set of characteristics. Characteristics which differentiate one item from other items may include such things as the weight of the item, the size of the item, whether the item requires special handling such as refrigeration, or perhaps because the item is particularly fragile, or because it may constitute a biohazard or the like. Additional factors may include a time sensitivity associated with the items, or a particular geographic area to which the item is to be delivered, or even a particular currier scheduled to transport the item.

With continued reference to FIG. 2, the items are sorted into groups which generally exhibit absolute discretion from other groups; that is, each group contains only items belonging to that group, and does not contain items associated with any of the other discrete groups. In practice, this generally involves some degree of physical separation 231 required between each of the sorted groups. This is typically accomplished by using one of several known techniques, generally involving ejecting incoming items from a conveyor in a first sorting station. In many installations, it may be convenient to sort groups of items onto a sorting table, accumulator, conveyor, or the like, or by ejecting the items in accordance with identifying characteristics into discrete chutes, bins, or the like, such that "like" items (as defined by predetermined characteristics) may be grouped together.

In order to achieve a physical separation between discrete groups (or compound groups) of sorted items, it may be desirable to assemble items within a particular class unto one region at a sorting station, and to assemble a different class of items onto a separate, distinct region at the first sorting station, and so on, depending on the number of different groups of items to be sorted. In this context, each distinct region within which a class of items is assembled would correspond to a sorting destination. In order to ensure that a physical space exists between discrete groups, many systems employ the concept of a unique target region or target zone associated with each class of items, wherein the various target regions corresponding to the different classifications of items are mutually exclusive.

In accordance with a further aspect of the present invention, the accumulator, sorting table, or other surface or structure wherein the intermediate sorting step is performed may also function as one or more of the following: (1) an accumulator for storing the intermediately sorted items until such time as they are reintroduced into the sorting process; (2) a transport mechanism for transporting the intermediately sorted items to a subsequent sorting or processing station; and (3) a conveyor or transfer mechanism for introducing the intermediately sorted items into a subsequent sorting or processing station.

With continued reference to FIG. 2, the various sorting stations are typically separated by a physical space or "dead zone" 231 between each of the groupings to ensure absolute discretion among the intermediately sorted groups. However, these dead zones can result in certain inefficiencies, such as un-utilized accumulator or transport space, un-utilized conveyor space, or the like.

Figure 8:
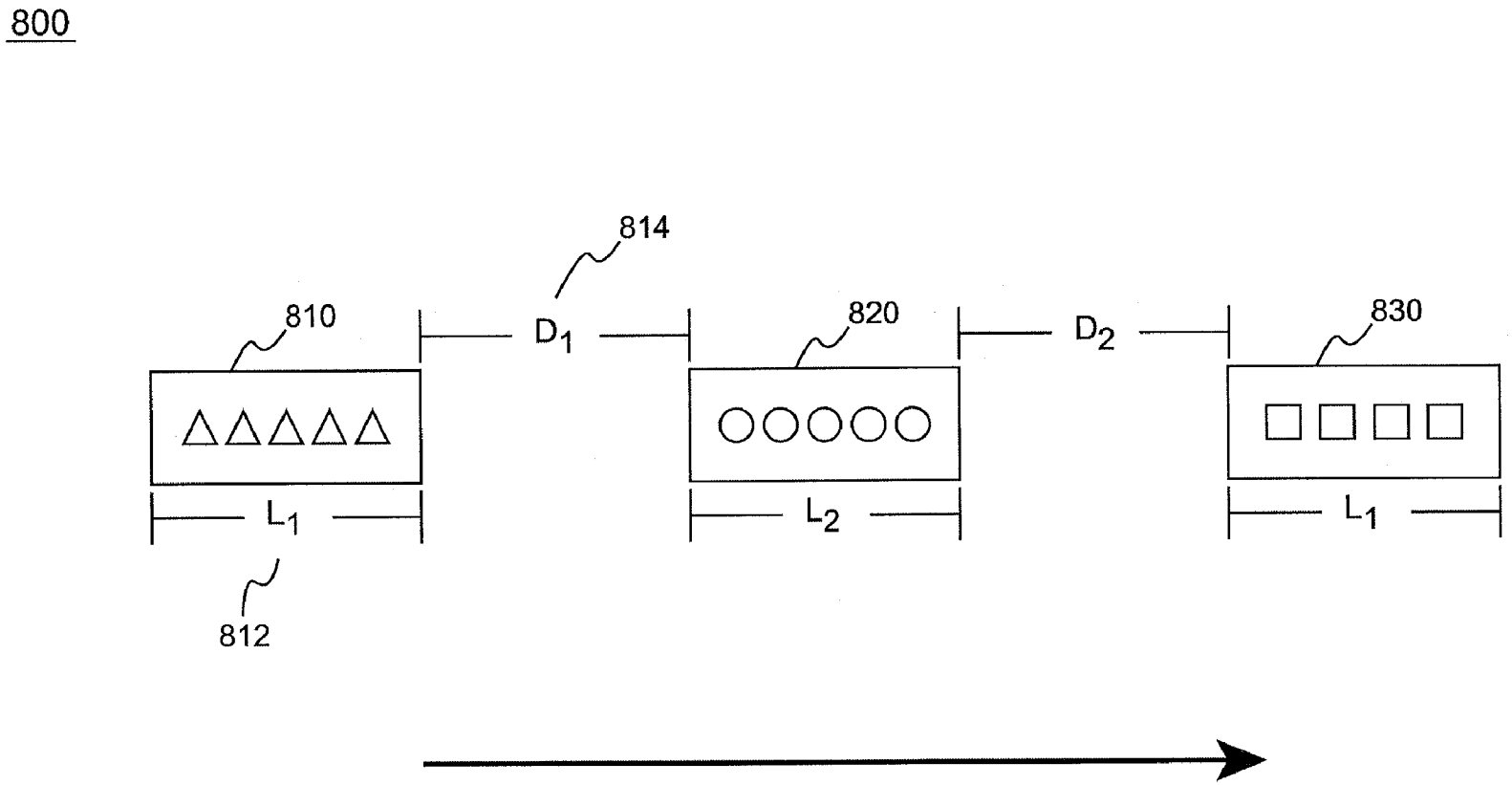
FIG. 8 is a schematic block diagram illustrating various characteristics of discretely sorted groups.

With reference to FIG. 8, exemplary intermediate sort destinations 800 maybe schematically represented as a series of discretely sorted groups of items, including a first sort destination 810, a second sort destination 820, and a third sort destination 830, with each sort destination characterized by a length L and separated from other sort destinations by a dead zone D. In the illustrated embodiment, destination 810 corresponds to an assembly of triangular items, destination 820 includes an assembly of circular items, and destination 830 includes an assembly of square items. Sort destination 820 is separated from destination 810 by a distance D1, and from destination 830 by a distance D2. Note that each sort destination includes a discretely sorted assembly of items sharing a similar characteristic or set of characteristics; that is to say sort destination 810 includes triangular items, but does not include circular items or square items; sort destinations 820 and 830 suitably exhibit similar homogeneity.

Figure 6:
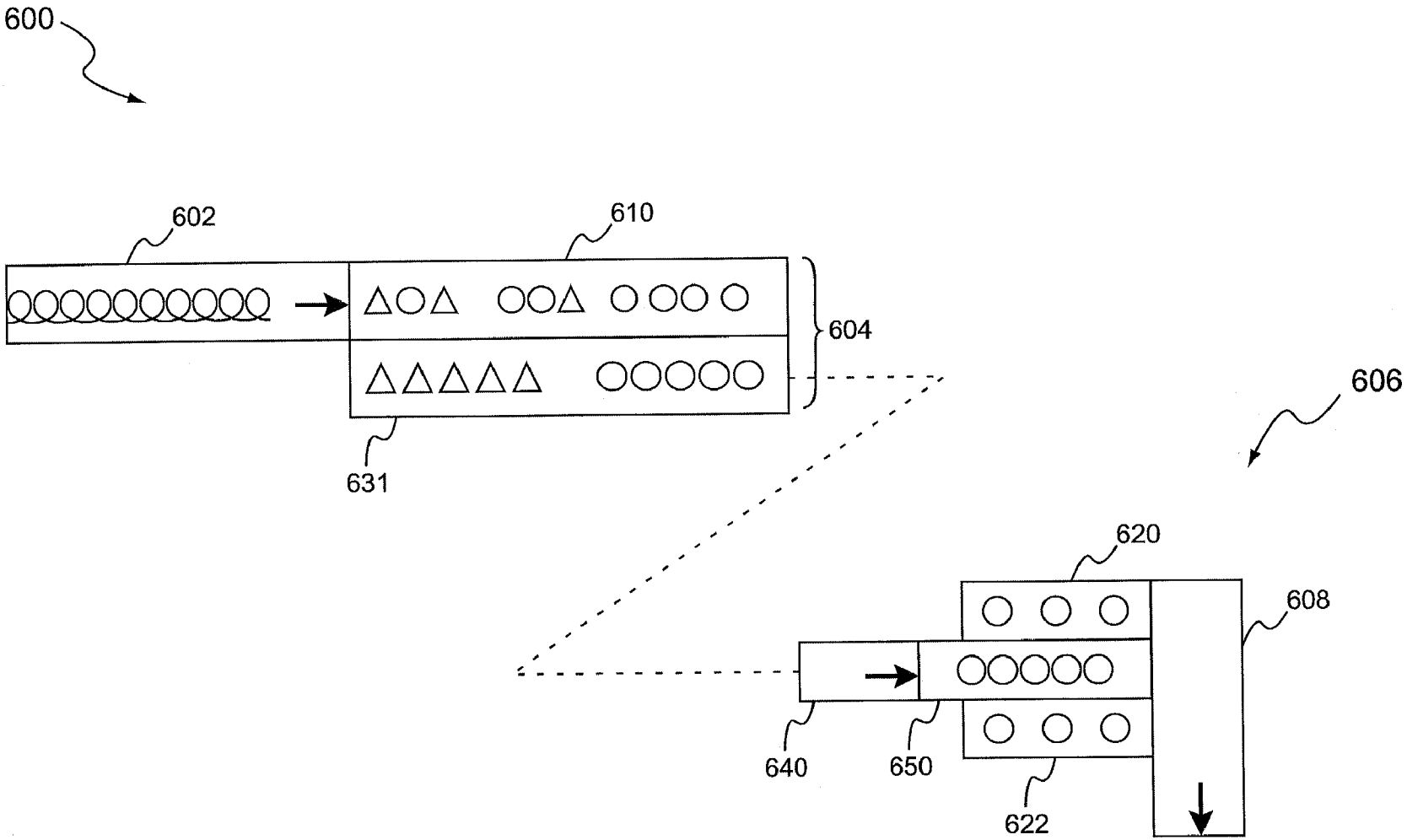
FIG. 6 is a schematic block diagram of a first sorting station and a second sorting station.
Figure 7:
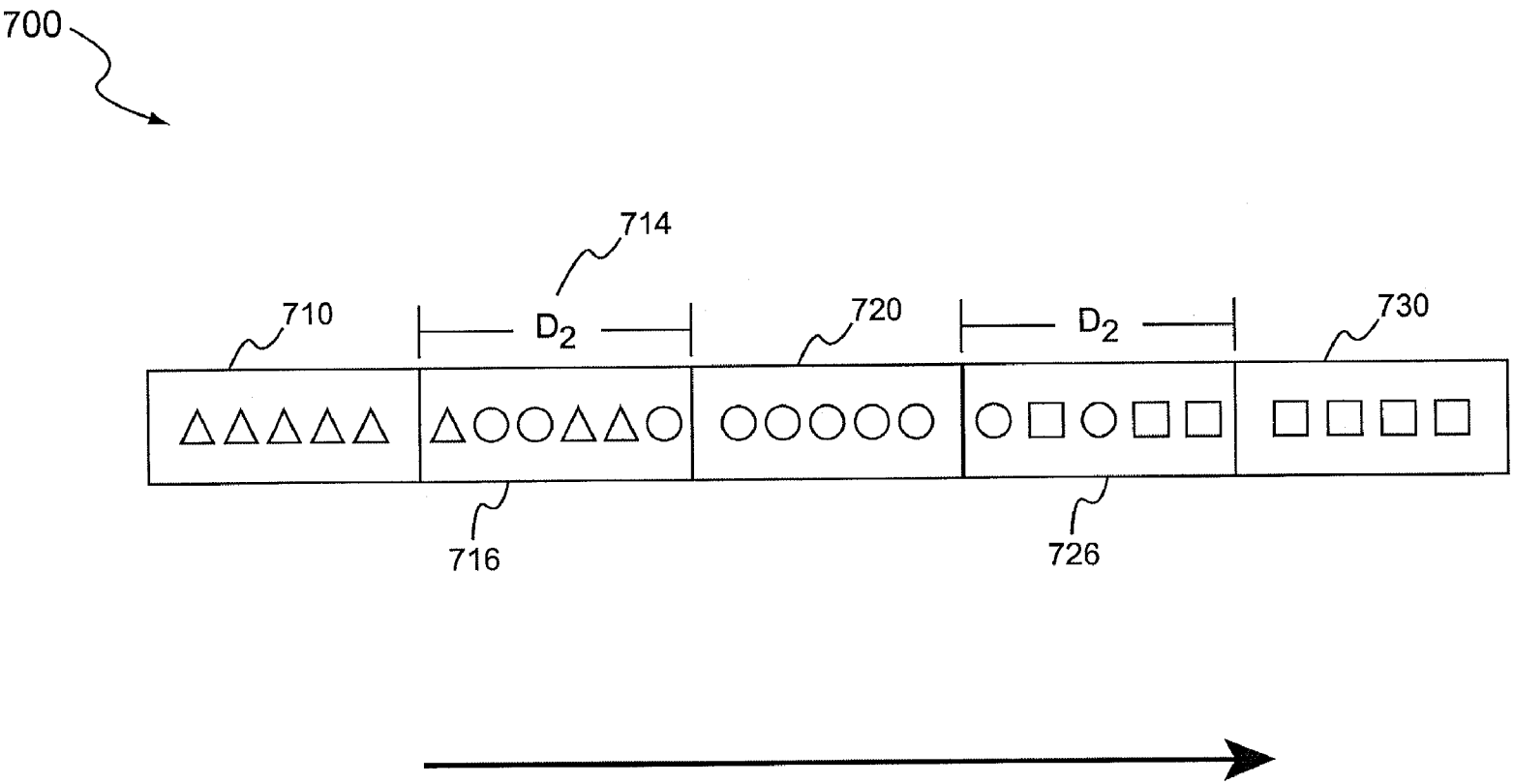
FIG. 7 is a schematic block diagram of a series of discrete sort regions, each separated by a non-discrete region.

With the output of the intermediate sort configured discretely as schematically shown in FIG. 8, the intermediately sorted items may then be processed in a subsequent sorting step. Referring now to FIG. 6, a sorting system 600 suitably comprises a primary induction conveyor 602, an intermediate (or primary) sorting station 604, and a final (or secondary) sorting station 606. Intermediate sorting station 604 suitably comprises a conveyor 610 for conveying unsorted items through the sorting station, and an accumulator 631 wherein the intermediately sorted items are assembled. As stated above, the intermediate sorting station may sort any number of different classes of items into any convenient number of intermediately sorted groups or compound groups; for clarity, intermediate sorting station 604 is illustrated as intermediately sorting items into two groups onto conveyor 631: a group of triangular items and a group of circular items.

With continued reference to FIG. 6, the intermediately sorted items on accumulator 631 are transported to sorting station 606, for example, by moving accumulator 631, proximate sorting station 606, by transferring the intermediately grouped items from accumulator 631 to an intermediary vehicle for transporting the intermediately grouped items to sorting station 606, or by manually carrying the sorting destinations which include the intermediately sorted items from sorting station 604 to sorting station 606.

Sorting station 606 suitably comprises an input conveyor 640 (which may be the same as accumulator 631, if desired), a sorting conveyor 650 (which may also comprise accumulator/conveyor 631), and one or more sort destinations. In the illustrated embodiment, sorting station 606 includes respective sorting destinations 620 and 622, each of which are shown having three sorting destinations, but which may comprise virtually any desired number of destinations, as appropriate. Moreover, in the embodiment shown in FIG. 6, the sorting destinations are positioned on both sides of sorting conveyor 650. It should be appreciated, however, that virtually any number of sorting destinations may be configured to interact with sorting conveyor 650 in any suitable manner. For example, the sorting destinations may extend along only one side of conveyor 650, along both sides, or a plurality of separate sorting destinations may be spaced apart from one another and placed along either or both sides of conveyor 650. Alternatively, sorting destinations may be positioned in various dimensions, such as above, below, circularly or semi-circularly circumscribing conveyor 650, as appropriate. Indeed, although conveyor 650 is shown as a linear conveyor in FIG. 6 for convenience, it will be understood that conveyor 650 may assume any desired configuration, such as a rotating table, a series of conveyors which may extend from input convey 640 in a parallel or non-parallel fashion.

With continued reference to FIG. 6, the discretely sorted groups introduced into sorting station 606 may be sorted into any number of desired groups. For example, when the compound group of intermediately sorted circles are processed at sorting station 606 as illustrated, one or more characteristics (or metrics) of these items may be identified and used to perform a higher resolution sort on these items. Depending on the number of characteristics used and the number of destinations employed at search station 606, the circular items conveyed along conveyor 650 are assembled into one or both of sorting destinations 620 and 622. The output of the items sorted in sorting station 606 may then be transported away, for example, through a transport (or "take away") vehicle 608 which may be a wheeled cart, conveyor, accumulator, or the like. In accordance with one aspect of the present invention, transport vehicle 608 may perform one or more of the functions articulated above with respect to the accumulator/conveyor associated with the intermediate sorting station.

If items within a particular group could be placed within the target zone with absolute certainty, i.e. if it could be assured that none of the items within a particular group extended outside the bounds of a target zone associated with that group's sort destination, then it would not be necessary to provide a space (or "dead zone") between different groups of items in order to ensure that each group was absolutely discrete (i.e., that only items within the classification which defines a group were located within the target zone). However, absolute precision in projecting items into a target zone is extremely difficult and costly to achieve.

Accordingly, presently known sorting technologies typically employ a physical separation between discrete groups to ensure that absolute discretion between groups is maintained. Moreover, since a physical range of uncertainty or deviation from a target zone is generally experienced, presently known systems employ a target zone as well as an expanded target zone, the latter including a range of deviation from the absolute target zone to accommodate those items which are not placed entirely within the absolute target zone. By maintaining a physical separation even between expanded target zones for adjacent groups, presently known systems are able to maintain absolute discretion between sequential groups while also accommodating for the uncertainty (and hence deviation) associated with the error in assembling items into an absolute target zone. One drawback associated with this approach, however, relates to the creation of so called "dead zones" which have heretofore been thought of as necessary to ensure the complete isolation (i.e., absolute discretion) of one group with respect to a nearby group of items.

For example, when an intermediate sorting step is employed to sort items into discrete groups on a conveyor, a dead zone may result in down time at a subsequent sorting station (i.e., no sorting is accomplished during conveyance of the dead zone through the sorting station), in addition to the inherent inefficiencies associated with unoccupied regions of a moving conveyor.

Referring again to FIG. 8, in accordance with a preferred embodiment of the present invention, zones $D_1$ and $D_2$ which, in prior art systems typically comprise dead zones where no items are present, may be exploited to achieve enhanced efficiencies by permitting some items from the adjacent target zones to be assembled into the "spaces" between discrete groups. For example, the target zone for group 810 is indicated by $L_1$. However, the present inventor has recognized that a sorting device which projects or otherwise assembles items into a group typically does so with a known degree of uncertainty. Hence, if the maximum uncertainty from target zone $L_1$ were expressed as $D_1$, and if the maximum deviation (or uncertainty) from target zone $L_2$ were less than or equal to length $D_1$, then it may be desirable to allow an intermediate non-discrete zone 814 to exist between respective discrete zones 810 and 820, as well as for the non-discrete zone $D_2$ between respective groups 820 and 830 and so on.

Thus, in accordance with this aspect of the invention, as long as absolute discretion within the actual target zones $L_1$ and $L_2$ is maintained, the presence of a non-discrete region of known dimensions between zones of absolute discretion can significantly enhance the overall efficiency of the sorting system, without compromising subsequent sorting, for example the discrete final sorting of items. Stated another way, during the intermediate sorting step depicted in FIG. 8, it is acceptable to allow a reasonable degree of entropy or randomness to exist in the intermediate non-discrete zones because this does not compromise the absolute discretion within the absolutely discrete zones. In this way, rather than having a dead zone between absolutely discrete regions wherein the sorting process is suspended, these "dead zones" may be exploited in the present invention as non-discrete zones to permit continuous sorting of non-discrete zones interspersed between the sorting of discrete zones.

Figure 3:
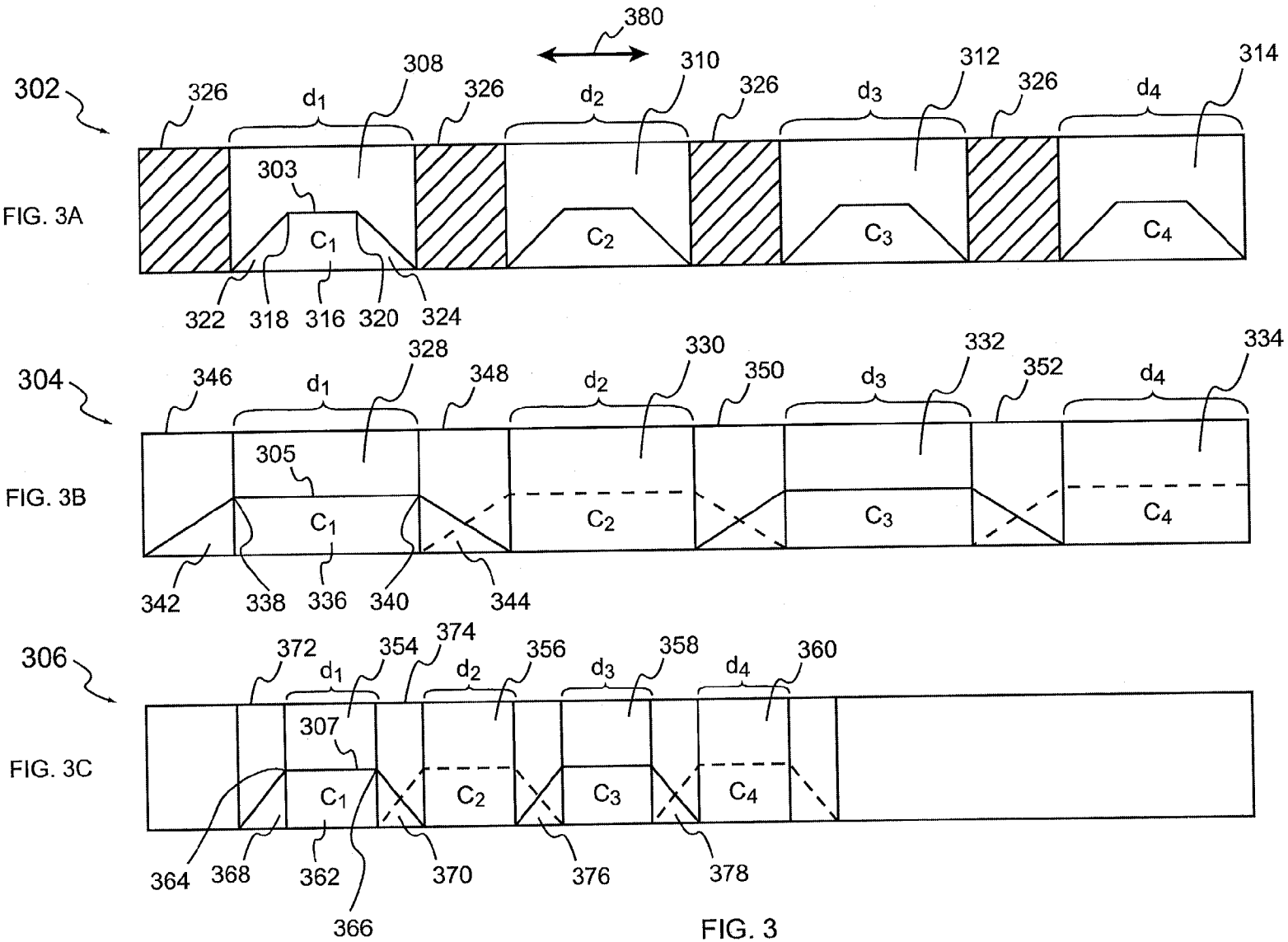
FIGS. 3(*a–c*) are graphical, schematic illustrations of various embodiments of discrete sorting regions.
Figure 4:
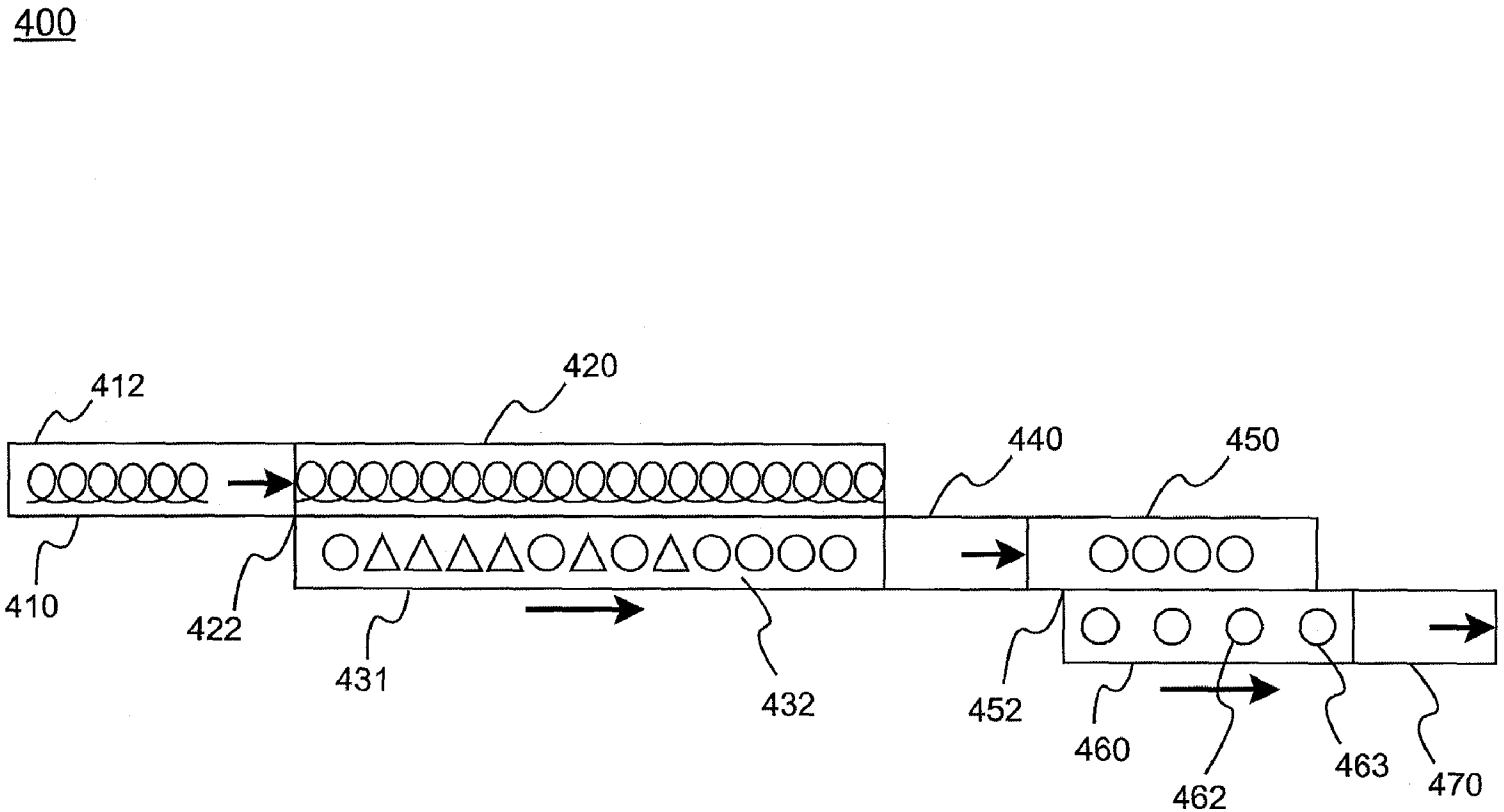
FIG. 4 is a schematic block diagram of a secondary sort station.

More particularly, in referring now to FIG. 3, target zones for assembling discrete groups of items at a sorting station are illustrated schematically. In FIG. 3A, a sorting platform (e.g. conveyor) 302 illustrates the known technique of assembling separate groups and maintaining absolutely discretion within the group through the use of dead zones between discrete groups. FIG. 3 illustrates one embodiment of the present invention wherein regions of non-discrete items are interposed between regions of discrete items utilizing approximately the same amount of sorting area (for example, the same length of conveyor belt as shown in FIG. 3A).

FIG. 3C sets forth an alternate embodiment of the present invention wherein non-discrete groups are interposed between discrete groups using a smaller area of total sorting capacity.

In the example shown in FIG. 3A, four groups of discrete items are intermediately sorted with dead zones between each discrete group to ensure absolute discretion within each group. An accumulator 326, which may be a conveyor belt, sorting table, or the like, comprises a first sorting area 308 for assembling a first class (C1) of items, a second sorting area 310 for assembling a second class (C) of items, a third sorting area 312 for assembling a third class (C3) of items, and a fourth sorting area 314 for assembling a fourth class (C4) of items. As discussed in greater detail below, sorting areas 308–314 may be refexted to as sorting destinations $D_1$–$D_4$, respectively. Thus, sorting station 326 may be said to include four separate sorting destinations for assembling four discrete groups of items $C_1$–$C_4$.

With continued reference to FIG. 3A, the target zone within which the sorting station is capable of assembling the items into area 308 is graphically depicted by a probability curve 303. More particularly, the absolute target zone within which items may be assembled (e.g., projected, ejected, dropped, or the like) is bound by the area under curve 303 between points 318 and 320. The error, or uncertainty, associated with a sorting station's ability to accurately assemble items into a target area is represented by a first error region 322 (shown to the left of point 318) and a second deviation area 324 (shown to the right of point 320). Thus, the entire area under probability curve 303 may be thought of as the expanded target zone and includes the absolute target zone between points 318 and 320, as well as the uncertainty target zones 322 and 324.

By determining the expanded target regions for the items to be sorted within a sorting station, and by placing appropriating dead zones 326 between the expanded target regions, absolute discretion among intermediately sorted groups may be maintained as shown in FIG. 3A. In this regard, it is instructive to define the target areas in terms of a unit of measure, schematically illustrated as unit 380, which may be expressed in terms of inches, feet, meters, or the like depending on the items to be sorted. In the embodiment shown in FIG. 3A, each of the absolute target zones are two units long, and include one unit of deviation on each side, so that the expanded target zones for each of the sorting destinations shown in FIG. 3A are four units in length. The respective dead zones 326 interposed between the sorting destinations are two units in length, although those skilled in the art will appreciate that any desired lengths or areas may be employed depending on the sorting objectives at that particular sorting station.

Referring now to FIG. 3B, a first embodiment of the present invention includes an accumulator (e.g. conveyor) 304 comprising a first area 328 for assembling items $C_1$, a secondary of 330 for assembling items $C_2$, a third area 332 for assembling items $C_3$, and a fourth area 334 for assembling items $C_4$. Thus, the accumulator shown in FIG. 3B may also be thought of as including four sorting destinations $D_1$–$D_4$ associated with four discrete groups. In contrast to the dead zone technique of maintaining absolute discretions set forth in FIG. A, the embodiment shown in FIG. 3B exploits this dead zone to allow the assembly of non-discrete items into the spaces between the absolute sorting destinations 328–334. More particularly, a non-discrete regions 348 interposed between discrete regions 328 and 330 allows for some of the $C_1$ items and some of the $C_2$ to be assembled into the non-discrete region.

Similarly, the embodiment shown in FIG. 3B allows for some of the $C_2$ items and some of the $C_3$ items to be assembled into a non-discrete region 350 interposed between discrete region 330 and discrete region 332, and so on with respect to non-discrete region 352.

The probability (or certainty) with which the sorting station is capable of assembling items $C_1$ into area 328 is expressed as a probability curve 305. In particular, the area under curve 305 between points 338 and 340 represents the absolute target zone within which items $C_1$ may be assembled into area 328.

An expanded target zone indicated by error regions 342 (to the left of absolute target region 336) and error zone 344 (to the right of absolute target region 336) represents the total length of conveyor 346 within which items C, may be assembled. Similarly, the degree of certainty with which the sorting station assembles items $C_2$ into area 330 may be expressed by an analogous probability curve, and so on with respect to areas 332 and 334. As a result, although items $C_1$ and $C_2$ may be assembled into non-discrete region 348, and items $C_2$ and $C_3$ may be assembled into non-discrete region 350, absolute discretion among the various sorted groups is nonetheless maintained inasmuch as area 328 contains only items $C_1$, area 330 contains only items $C_2$, and so on. In this way, absolute discretion is maintained within sorting destinations $D_1$–$D_4$, while exploiting the physical space between discrete sorting destinations.

Moreover, the embodiment shown in FIG. 3B provides for discrete sortation of four groups of items without requiring additional accumulator space. In accordance with a further aspect of this embodiment, the absolute target zones may be increased from two to four units, and the total target zone may be increased from four to eight units as compared to the embodiment shown in FIG. 3A, without consuming additional accumulator area. As described in greater detail below in connection with FIG. 5, the advantages associated with the embodiment shown in FIG. 3B may be achieved while still maintaining absolute discretion among sorted groups in a subsequent sorting process.

With momentary reference to FIG. 3C, an alternate embodiment of the present invention provides an accumulator 306 having sorting areas 354, 356, 358 and 360 for discretely sorting items $C_1$–$C_4$ in much the same way as discussed above in connection with FIG. 3B. In the embodiment shown in FIG. 3C, however, a probability curve 307 comprises an absolute target zone of two units of length between points 364 and 366, having respective error regions 368 and 370 on either side of the absolute target zone, with the error regents being one unit of length. In this way, the expanded target zones for each of the groups is the same as shown in FIG. 3A. By providing respective non-discrete regions 374, 376, and 378 between the discrete regions, and further by ensuring that the area of each non-discrete region is sufficient to accommodate the uncertainty zones associated with the nearby discrete regions, absolute discretion is maintained within each of sorting destinations $D_1$–$D_4$, while at the same time eliminating dead zones. In accordance with one aspect of the embodiment shown in FIG. 3C, four discrete groupings are obtained while using substantially less accumulator area, resulting in significant savings in capital equipment.

Those skilled in the art will appreciate that various factors may be considered when designing intermediate sorting processes having non-discrete regions in accordance with the present invention, including conveyor speed, the coefficients of friction between items and the surface of the conveyor, the size, weight, and number of items to be sorted, and the like. Furthermore, in accordance with the present invention, various tradeoffs may be made between capital equipment cost, speed, and other factors allowing customization and optimization of various sorting processes through the use of intermediate short steps which include non-discrete regents.

Figure 5:
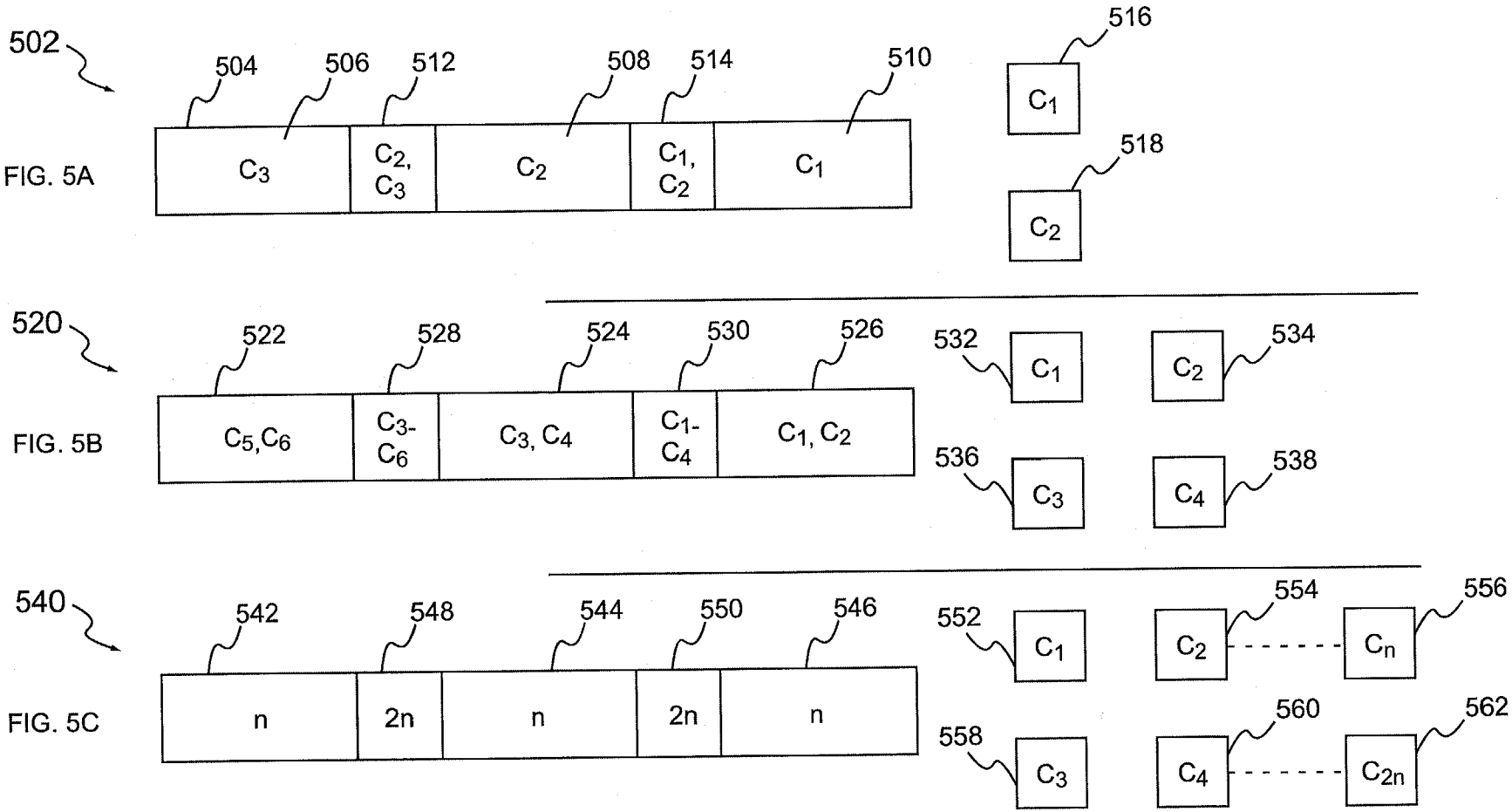
FIGS. 5(*a–c*) are schematic block diagrams of various embodiments of secondary sort stations.

Referring now to FIG. 5, various final sorting processes will now be discussed. In this regard, the present inventor recognizes that incorporating non-discrete regions in an intermediate sorting process requires that the existence of these non-discrete regions be accommodated in a subsequent (e.g. final) sorting process.

The principals enunciated herein may be extended to virtually any number of classifications of items in the context of a sorting system involving a discrete final sort and one or more intermediary non-discrete sorting steps.

In a single stage sorting environment, a single destination is typically used for each discrete group that the incoming items are sorted into. Thus, in a single stage process, the number of sorting destinations (d) is equal to the number of sorted groups (S). For a conventional two stage discrete sorting process, the number of discrete groups may be expressed as $S_1 \times S_2$ where $S_1$ is the number of sorts in the first or primary sorting step, and $S_2$ is the number of sorts performed in the secondary sorting process. For this type of discrete sortation, the number of sorting destinations may be expressed as $d=S_1+S_2$. These relationships can be extrapolated to virtually any number of discrete sorting steps, such that the total number of sorted groups is equal to the product of the respective number of groups sorted at each of the stages ($S_1 \times S_2 \ldots \times S_n$), and wherein the number of sorting destinations is equal to the sum of the respective sort points at each stage ($S_1+S_2 \ldots +S_n$).

In accordance with one aspect the present invention, the tradeoff for relaxing the requirement of absolute discretion among sorted groups at an intermediate sorting stage involves an increase in the total number of sort destinations compared to the total number of sort destinations that would be required for the same number of total groups in a fully discrete multi-stage sorting process.

Thus, in the context of the present invention, for a two stage sort the total number of discrete groups may be expressed as $S_1 \times S_2$, where again $S_1$ is the number of sort points at the primary sorting stage and $S_2$ is the total number of sort points in the secondary sorting stage. In this context, the primary sorting stage is the intermediate, non-discrete sorting process discussed above, and the secondary sorting stage is the subsequent or, in the case of a two stage sortation process, the final sorting stage. However, in contrast to prior art sortation processes in which each stage maintains discretion between each sorted group, the number of sorting destinations required in the present invention may be expressed as $S_1+S_2+D_2$, where $S_1$ is the number of sorting points in the primary stage, $S_2$ is the number of sort destinations in the secondary stage, and $D_2$ is the number of $S_2$ groups from a discrete zone which can overlap with $S_2$ groups of an adjacent discrete zone in the uncertainty zones in the non-discrete sort.

The present invention thus provides one or more intermediate sorting steps in a two stage or multi-stage sort which allows greater flexibility in defining target zones and non-discrete zones during an intermediate sorting step, and which may be implemented using a secondary sorting stage with fewer total sorting destinations then would be required to sort the same number of groups in a conventional single stage sort. Although the number of discrete sorting destinations employed in the present invention will generally be greater than the number of destinations required to sort the same number of groups in a conventional multi-stage discrete sorting paradigm, in many applications the benefits of greater flexibility in defining the target zone far outweigh the incremental cost of additional sorting destinations.

Referring now to FIG. 5, the manner in which the output intermediate non-discrete sorting stage is accommodated in a subsequent sorting stage in the context of the present invention will now be described.

FIG. 5(*a*) is a schematic diagram of a secondary sortation process which follows a previous (intermediate), non-discrete sorting process in accordance with the present invention. More particularly, a secondary sorting station 502 comprises a conveyor 504 configured to introduce intermediately sorted items into the secondary sorting process. Conveyor 504 comprises respective discrete regions 506, 508, 510, and respective non-discrete regions 512 and 514.

As discussed in greater detail below in connection with FIGS. 5(*b*) and 5(*c*), the intermediate non-discrete sorting process may be implemented in virtually any number of sorting stages in accordance with the present invention; for simplicity, the simple case of $S_2=1$ will first be described in the context of FIG. 5(*a*). That is, sorting stage 502 is a single point sorting stage, which is configured to place discretely sorted items into takeaway bins, and is not intended to further sort discretely sorted groups into smaller groups.

If the items grouped on conveyor 504 were discretely sorted as discussed above in connection with FIG. 3(*a*), regions 506–510 would comprise discretely sorted items, and regions 512 and 514 would simply comprise dead zones. In such a case, only a single sorting destination, for example destination 516, would be required, to the extent the sort destination could "clear" its load during the dead zones, for example by opening Bombay doors, replacing a full bin with an empty bin, or the like.

With continued reference to FIG. 5(*a*) and in accordance with the present invention, a first class of items ($C_1$) are discretely assembled in area 510, a second group of items ($C_2$) are discretely assembled within area 508, and a third group of items ($C_3$) are discretely assembled onto area 506. Depending on the number of sort points associated with the prior non-discrete sortation process, conveyor 504 may contain virtually any number of discretely grouped items.

In the embodiment illustrated in FIG. 5(*a*) wherein $S_2=1$, when area 510 is sorted, the discretely sorted items $C_1$ are sorted into sorting destination 516. When sorting stage 502 has finished processing area 510, non-discrete region 514 is then processed, such that the goods in Class $C_1$ are placed into sorting destination 516, and the items corresponding to Class $C_2$ are placed into sorting destination 518. Thereafter, items corresponding to Class $C_2$ are transferred from area 508 into sorting destination 518, during which time sorting destination 516 can clear its load. Thus, for the case where $S_2=1$, the total number of sorting destinations required for sortation stage 502 may be expressed as $S_2+D_2$, where $D_2$ corresponds to the maximum number of items from a discrete zone which may be assembled into its adjacent non-discrete zone. In the context of FIG. 5(*a*), since each discrete zone includes only one class of items, $D_2$ is equal to 1, so that a total of two sorting destinations are needed for the embodiment shown in FIG. 5(*a*).

Referring now to FIG. 5(*b*), a secondary sorting station 520 is illustrated for the case where $S_2=2$; that is, each discretely sorted group which is introduced into the secondary sorting stage is sorted into two groups.

Sorting station 520 of FIG. 5(*b*) comprises discretely sorted zones 522, 524, and 526, interposed with non-discrete zones 528 and 530. Discrete zone 526 includes only items corresponding to Class 1 and Class 2, discrete zone 524 includes only items in Class 3 and Class 4, and discrete zone 522 includes only items in Class 5 and Class 6, and so on. As discussed above, some of the items from Class 1 and Class 2 may also spill over into non-discrete region 530. Similarly, some of the items from Class 3 and Class 4 may spill over from discrete zone 524 into non-discrete zone 530. Thus, it is possible that four different classes of items may be assembled into non-discrete region 530.

Similarly, non-discrete region 528 may include some items from Class 3 and Class 4, as well as some items from Class 5 and Class 6 which may have spilled over from discrete region 522. During processing of discrete region 526, items from Class 1 and Class 2 are assembled into sorting destinations 532 and 534, respectively. However, because the non-discrete regions in FIG. 5(*b*) may include up to four classes of items (two classes from each of the adjacent discrete regions), additional sorting destinations 536 and 538 are needed to accommodate sorting of the non-discrete regions. The maximum number of groups which may be assembled into a non-discrete region from an adjacent discrete region in the embodiment shown in FIG. 5(*b*) is two. Hence, the total number of sorting destinations for the embodiment figure shown in FIG. 5(*b*) may be expressed as $S_2+D_2=2+2=4$.

With reference to FIG. 5(*c*), the secondary sorting stations which may be used in the context of the present invention following an intermediate non-discrete sorting stage may be extrapolated to virtually any number of sorting points as subscript 2 as are desired in the secondary sorting stage.

More particularly, secondary sort stage 540 suitable comprises $S_1$ (the number of sort points in the previous sorting stage) discrete regions, for example regions 542, 544, and 546. Non-discrete regions such as regions 548 and 550 may be interposed between discrete regions, as desired. As discussed above in connection with the prior art discrete sortation process shown in FIG. 3(*a*), the total number of sort destinations needed in the embodiment shown in FIG. 5(*c*) would be equal to n if the discrete regions were separated by dead zones. However, in accordance with the present invention wherein non-discrete regions are interposed between the discrete regions, a maximum of 2n sorting destinations would be needed to ensure discrete sorting at the output of stage 540. That is, since the maximum number of items which may spill over from a discrete zone into an adjacent non-discrete zone corresponds to $S_2$=n, then a total number of destinations for the secondary sort may be expressed as $S_2+D_2=n+n=2n$.

Depending on the particular items being sorted, it may be possible to enjoy even further efficiencies in accordance with various other aspects of the present invention. For example, in order to reduce the number of total sorting destinations in the secondary sorting stage, it may be desirable to perform a discrete sort of the discrete regions, and to process the items in the non-discrete zones as dictated by the particular application. For example, items in the non-discrete zone may be low cost commodities such as dirt, sand, water, or the like, which could simply be discarded. Alternatively, items in the non-discrete region could be recycled through the sortation process, for example by reintroducing the non-discrete items into the non-discrete sorting process. In accordance with yet a further aspect of the present invention, if it can be determined that certain classes of items have a high probability of appearing in a non-discrete zone, and other classes of items have a very low probability of appearing in the non-discrete zone, it may only be necessary to provide final sorting destinations for those items likely to appear in the non-discrete zones.

If it desired to discretely sort all of the items in the non-discrete regions during the secondary sortation process, the total number of sorting destinations required in accordance with the present invention exceeds the number of sorting destinations which would be required to sort the same number of groups using only discrete intermediate sortation. However, the total number of sorting destinations needed in the present invention is still far less than the total number of sorting destinations needed to sort the same number of groups using a single stage process. Moreover, in many applications the efficiencies enjoyed from relaxing the target zones in the intermediate sort far outweigh the incremental increase in file sort destinations needed at the secondary sort.

For example, although the number of sort points in the first and second stages of a two stage process is largely a matter of design choice in view of the particular application, a comparison of total number of sort destinations is in the present invention vis-a-vis prior art techniques may be simplified by presuming that the first and second sort stages have the same number of sort points. That is, $S_1=S_2=S$. The following chart compares the total number of sorting destinations needed to discretely sort a given number of total Groups to be sorted. In a discrete two stage process, the total number of sorting destinations $d=G=S_1+S_2=2s$. For the non-discrete intermediation step described herein, the maximum number of total sort destinations for a two stage process may be expressed as $d=S_1+2\ S_2=3s$. Finally, sorting the same number of Groups using a single stage process would require a total number of sorting destinations $d=G=S^2$.

TABLE 1

| G (# of groups) | S | Discrete Intermediate Sort | Non-discrete Intermediate Sort | Single Stage |
|---|---|---|---|---|
| 4 | 2 | 4 | 6 | 4 |
| 9 | 3 | 6 | 9 | 9 |
| 25 | 5 | 10 | 15 | 25 |
| 100 | 10 | 20 | 30 | 100 |
| 400 | 20 | 40 | 60 | 400 |
| 2,500 | 50 | 100 | 150 | 2,500 |

In accordance with various aspects and embodiments of the present invention, this above-described system relaxes the notion that minimum entropy (maximum order) is required at each discrete stage of the system. As described herein, the relaxing of the target zone and the use of non-discrete regions result in numerous efficiencies for the sorting system thereby offering remarkable improvements in overall operational costs.

While the present invention is set forth herein in the context of the appended drawing figures, it should be appreciated that the invention is not limited to the specific form shown. For example, several figures demonstrate a two-stage sorting process comprising a primary and secondary stage sort. As practitioners in the art will appreciate, much greater levels of complexity may be employed in accordance with the present invention. For example, a sorting system may be comprised of a dozen or more intermediate sorting stations. Further, several drawings demonstrate a simplistic sorting process comprised of two or three groups of items. However, those skilled in the art will appreciate that the present invention has application in much more complex sorting and distribution systems, comprising quaternary and various other higher-level order sorting metrics.

Additionally, practitioners will also appreciate that intermediate sorting processes may also occur at the various induction points or upon transfer to various sort stations.

I claim:

1. A method of sorting items, comprising the steps of:

introducing unsorted items into a first sorting station of the type which includes a first conveyor;

performing a first sorting process on said unsorted items at said first sorting station, including the steps of:

identifying a first class of said items characterized by a first characteristic and a second class of said items characterized by a second characteristic;

assembling a first plurality of said first class of items into a first region of said first conveyor such that said first area is devoid of items from said second class;

assembling a second plurality of said second class of items into a second region of said first conveyor such that said second area is devoid of items from said first class; and permitting items from said first and second classes to be assembled into a non-discrete region of said conveyor during said assembling steps, wherein said non-discrete region is exclusive of and located between said first and said second regions;

performing a second sorting process, subsequent to said first sorting process, including the steps of:

transferring said first plurality of items from said first region to a first takeaway bin; and transferring said second plurality of items from said second region to a second takeaway bin.

2. The method of claim 1, wherein said second sorting process further comprises the steps of:

transferring any first class items from said non-discrete region to said first takeaway bin; and transferring any second class items from said non-discrete region to said second takeaway bin.

3. The method of claim 1, wherein said second sorting process further comprises the step of discarding any items in said non-discrete region.

4. The method of claim 1, wherein said second sorting process further comprises the step of reintroducing any items from said non-discrete region into said first sorting station.

5. The method of claim 1 further comprising the step of singulating said unsorted items prior to said introducing step.

6. The method of claim 1 further comprising the step of serially introducing said items into said first sorting station.

7. The method of claim 1, wherein said first characteristic comprises at least one of the following parameters:

the weight of an item;

the size of an item; and the zip code to which an item is to be sent.

8. The method of claim 1, wherein said introducing step comprises the step of serially conveying singulated unsorted items into said first sorting station.

9. The method of claim 1, further comprising the step of serially conveying said first and second plurality of items into said second sorting process.

10. The method of claim 1, wherein said first conveyer comprises a movable belt-type conveyor.

11. The method of claim 10, wherein said first and second regions comprise respective first and second target zones on said first conveyor, each having a predetermined area.

12. The method of claim 11, wherein said target zones comprise a substantially rectangular area, and said non discrete region comprises a substantially rectangular area between said target zones.

13. The method of claim 11, wherein:

said introducing step comprises introducing said unsorted items using a primary induction conveyor; and said assembling steps comprise the steps of ejecting said first class of items from said primary induction conveyor to said first target zone, and ejecting said second class of items from said primary induction conveyor to said second target zone.

14. The method of claim 13, wherein said permitting step comprises the step of ejecting items from said primary induction conveyor to said non discrete region.

15. The method of claim 1, wherein said second sorting process is performed at a second sorting station.

16. The method of claim 15, further comprising the steps of moving said first conveyor, upon completion of said first sorting process, to said second sorting station and introducing said items into said second sorting station via said first conveyor.

17. A method of sorting items, comprising the steps of:

introducing items into a first sorting station of the type which includes $S_1$ sort destinations;

performing a first sorting process on said items at said first sorting station, including the steps of:

sorting a first subset of items into $S_1$ discrete groups of items and placing each one of said $S_1$ discrete groups into a respective one of said $S_1$ sort destinations;

providing a non-discrete region proximate two of said $S_1$ sort destinations, and placing onto said non-discrete region a second subset of said items which is exclusive of said first subset of items;

performing a second sorting process, subsequent to said first sorting process, said second sorting process having associated therewith a first set of $S_2$ sort destinations and a second set of up to $S_2$ sort destinations, said second sorting process including the steps of:

sorting each one of said $S_1$ discrete groups of items into $S_2$ discrete groups of items and placing each one of said $S_2$ discrete groups into a respective one of said first set of $S_2$ sort destinations;

transferring said second subset of items from said non-discrete region into at least one of: said first set of $S_2$ sort destinations and said second set of up to $S_2$ sort destinations.

18. The method of claim 17, wherein at least one of said second set of up to $S_2$ sort destinations comprises a recycle path, and said second sorting process further comprises the steps of:

transferring at least a portion of said second set of items from said non-discrete region to said recycle path; and reintroducing said portion of said second set of items into said first sorting station.

19. The method of claim 17, wherein at least one of said second set of up to $S_2$ sort destinations comprises a discard path, and said second sorting process further comprises the step of discarding any items in said discard path.

20. The method of claim 17, wherein said second sorting process further comprises the step of reintroducing any items from said non-discrete region into said first sorting station.

21. The method of claim 17 further comprising the step of singulating said items prior to said introducing step.

22. The method of claim 17 further comprising the step of serially introducing said items into said first sorting station.

23. The method of claim 17, wherein said transferring step comprises the steps of discretely sorting said second subset of items into said first set of $S_2$ sort destinations and into said second set of up to $S_2$ sort destinations.

24. The method of claim 17, wherein said introducing step comprises the step of serially conveying singulated unsorted items into said first sorting station.

25. The method of claim 17 further comprising the step of serially conveying said $S_1$ sort destinations into said second sorting process.

26. The method of claim 17, wherein said second subset of items in said non-discrete region comprises an item which correspondences to at least one of:

i.) a first one of said $S_1$ discrete groups of items; and ii.) a second one of said $S_1$ discrete groups of items.

27. The method of claim 26, wherein said second subset of items comprises at least one item from each of said first one of and said second one of said $S_1$ discrete groups.

28. The method of claim 17, wherein each of said $S_1$ sort destinations comprises a target zone on a first conveyor, said target zone having a predetermined area.

29. The method of claim 28, wherein said target zones comprise a substantially rectangular area, and said non-discrete region comprises a substantially rectangular area between two of said target zones.

30. The method of claim 29, wherein said second sorting process is performed at a second sorting station.

31. The method of claim 30, further comprising the steps of moving said first conveyor, upon completion of said first sorting process, to said second sorting station and introducing said items into said second sorting station via said first conveyor.

32. The method of claim 30, wherein said second set of sort destinations comprises $S_2$ sort destinations.

33. The method of claim 32, wherein said second sorting station comprises $2S_2$ sorting destinations.

34. The method of claim 17, wherein said second set of sort destinations comprises $S_2$ sort destinations.

* * * * *